US009858906B2

(12) United States Patent
Visesnut et al.

(10) Patent No.: US 9,858,906 B2
(45) Date of Patent: Jan. 2, 2018

(54) MUSICAL INSTRUMENT CASE HAVING AN ADJUSTABLE SUPPORTING MEANS

(71) Applicants: Narongsak Visesnut, Nonthaburi (TH); Patorn Visesnut, Bangkok (TH)

(72) Inventors: Narongsak Visesnut, Nonthaburi (TH); Patorn Visesnut, Bangkok (TH)

( * ) Notice: Subject to any disclaimer, the term of this patent is extended or adjusted under 35 U.S.C. 154(b) by 0 days.

(21) Appl. No.: 15/125,101

(22) PCT Filed: Sep. 9, 2014

(86) PCT No.: PCT/TH2014/000042
§ 371 (c)(1),
(2) Date: Sep. 9, 2016

(87) PCT Pub. No.: WO2016/007097
PCT Pub. Date: Jan. 14, 2016

(65) Prior Publication Data

US 2017/0018263 A1 Jan. 19, 2017

(30) Foreign Application Priority Data

Jul. 7, 2014 (TH) ..... 1401003923

(51) Int. Cl.
*A45C 11/00* (2006.01)
*G10G 5/00* (2006.01)
(Continued)

(52) U.S. Cl.
CPC ..... *G10G 5/00* (2013.01); *B65D 81/127* (2013.01); *G10D 1/08* (2013.01); *G10G 7/005* (2013.01)

(58) Field of Classification Search
CPC ..... B65D 81/127; G10D 1/08; G10G 5/00; G10G 7/005
(Continued)

(56) References Cited

U.S. PATENT DOCUMENTS 4,846,340 A * 7/1989 Walther ..... A45C 5/02 206/14
5,833,051 A * 11/1998 Tiefenbrun ..... G10G 7/005 206/14
(Continued)

FOREIGN PATENT DOCUMENTS

JP 51-140453 11/1976
JP 57-38708 Y2 8/1982
(Continued)

OTHER PUBLICATIONS

International Search Report received in PCT/TH2014/000042, dated Jan. 20, 2015.
(Continued)

*Primary Examiner* — Luan K Bui
(74) *Attorney, Agent, or Firm* — Suzannah K. Sundby, Esq.; Canady + Lortz LLP

(57) ABSTRACT

The present invention relates to a musical instrument case (10) for storing a musical instrument, comprising a case body (12) having an inner wall (16), a cover (18) is attached to the case body (12), an adjustable supporting means (24) is affixed on the inner wall (16) wherein the adjustable supporting means (24) comprising at least one of cushioning unit (26) and each cushioning unit (26) is connectable by a rope (28), wherein the cushioning unit (26) is expanded to securely grip the musical instrument when the rope (28) is pulled and can be adjusted to fit with various sizes of the musical instruments.

15 Claims, 13 Drawing Sheets

(51) Int. Cl.

| | |
|---|---|
| ***G10D 1/08*** | (2006.01) |
| ***G10G 7/00*** | (2006.01) |
| ***B65D 81/127*** | (2006.01) |

(58) Field of Classification Search
USPC ..... 206/14, 314, 522, 523, 591, 592, 594
See application file for complete search history.

(56) References Cited

U.S. PATENT DOCUMENTS

| | | | | |
|---|---|---|---|---|
| 5,875,890 | A * | 3/1999 | Di Bernardini | G10D 9/06 206/314 |
| 6,029,804 | A * | 2/2000 | Flynn | G10G 7/005 206/14 |
| 6,283,287 | B1 | 9/2001 | Carl | |
| 6,951,280 | B1 * | 10/2005 | Lee | A45C 9/00 206/14 |
| 7,687,701 | B1 * | 3/2010 | Kushner | G10G 7/005 206/314 |
| 2002/0070129 | A1 * | 6/2002 | Tunstall-Behrens | B65D 85/64 206/314 |
| 2006/0027472 | A1 | 2/2006 | Gokcen et al. | |
| 2006/0086637 | A1 * | 4/2006 | Chen | A45C 13/021 206/314 |

FOREIGN PATENT DOCUMENTS

| | | |
|---|---|---|
| JP | 1985-165216 | 5/1987 |
| JP | 1990-21015 | 11/1991 |

OTHER PUBLICATIONS

Written Opinion received in PCT/TH2014/000042, dated Jan. 20, 2015.

* cited by examiner

MUSICAL INSTRUMENT CASE HAVING AN ADJUSTABLE SUPPORTING MEANS

TECHNICAL FIELD

The present invention relates to a musical instrument technology. More specifically, this application relates to a musical instrument case having an adjustable supporting means in which the adjustable supporting means can be adjusted and expanded to securely grip a musical instrument with various sizes contained therein.

BACKGROUND ART

In the field of musical instrument, especially string instruments, such as guitar, one of the main considerations is how to keep maintaining the instruments in the best condition in terms of appearance as well as sound quality of the instruments. The instruments such as a classical guitar is often expensive, therefore, the great care of musical instrument is so desirable. A good musical instrument case is so important in order to protect the instrument in good condition.

A conventional musical instrument case comprises a case body for receiving a musical instrument and a cover. An outer wall of the musical instrument case is made from strong material which can be bump resistance in order to protect the musical instrument containing therein. An inner wall of the case body is lined with a soft material in order to protect the musical instrument.

The existing musical instrument case has disadvantages in which although the inner wall is lined with the soft material, there is still having a gap or space between the instrument and the inner wall. When the case is transported or carried, the instrument can unexpectedly shifted or moved during transportation and thus, it can cause damage to the instrument.

In addition, there is another disadvantage in which the conventional musical instrument cases have been designed to fit for a specific instrument model. That is, if a musician replaces the old instrument with the new one having different sizes or models, it is necessary to buy a new case to fit the new musical instrument.

European Patent Publication No. EP 1 950 734 A2 discloses a portable casing for carrying musical instrument securely. The casing interior is provided with flexible shock absorbing supports on which the non-vulnerable portions of the instrument are laid whereas the delicate and vulnerable portions are held suspended in mid-air. As soon as the casing is closed, the supports get deformed acquiring a loop-shaped structure to encircle and cradle the instrument—parts which overlie thereon and in doing so the instrument is rendered securely captive against any movement.

U.S. Pat. No. 5,833,051 discloses a multifunctional musical instrument case having a rigid case frame. The case includes a plurality of inflatable bladders for defining a compartment for receiving a guitar and for resiliently supporting the guitar placed in the compartment. The bladders when inflated or expanded substantially surround and grip the guitar in the compartment. The inflatable bladders will help securely supporting the instrument from any movement during transportation.

US Patent Publication No. US 2010/0252464 A1 discloses a soft musical instrument case having an inflatable bladder system permit protected storage and transportation of the instrument. The inflatable bladders will help securely supporting the instrument from any movement during transportation.

However, there are still the disadvantages, in which, the application of the bladder systems to help securely supporting the instrument is difficult to use. It requires a lot of the devices to inflate the bladders. The manufacturing of the conventional case is also complicated. The bladders can be exploded or having leakage during use.

In addition, most of the conventional musical instrument cases include a single wall structure. Therefore, the strength of the case may not sufficiently strong. Although it includes several layers of material, the strength still does not increase as it expected to.

There has been developed using a double-wall structure, in which usually using a foam sheet having an adhesive bonding with the outer wall or lining with foam or fabric. The disadvantage is that the case is still not sufficiently strong as it expected to be.

As described above, there is thus a need for convenient, efficient musical instrument case with a mechanism to adjust the size of the inner wall of the case to securely grip the instruments of various sizes in order for maintaining the instrument effectively.

SUMMARY OF THE INVENTION

The present invention relates to a musical instrument case for storing a musical instrument, comprising a case body having an inner wall, a cover is attached to the case body.

An adjustable supporting means is affixed on the inner wall wherein the adjustable supporting means comprising at least one of cushioning unit, and each cushioning unit is connected by a rope, wherein the cushioning unit is expanded to securely grip the musical instrument when the rope is pulled.

The cushioning unit comprises an upper closing end, a lower opening end, an upper wall, a lower wall, a first side wall and a second side wall wherein a soft material is enclosed inside the cushioning unit and the second side wall is attached to the inner wall of the case body.

The upper wall and the lower wall comprise a crease wherein when the rope is pulled, the crease is expanded pushing the soft material to securely grip the musical instrument. The soft material is enclosed with a fabric.

The object of the present invention is to provide the musical instrument case having an adjustable supporting means which can be adjusted to securely grip the musical instrument with different sizes or models contained therein.

Another object is to provide the musical instrument case having the adjustable supporting means that can efficiently easily use and having aesthetic appearance.

Another object is to provide the musical instrument case that can be adjusted for storing the musical instrument with different sizes or models, in particulars stringed instruments including guitar and other instruments having similar shape to guitar such as violin, ukulele, etc.

Another object is to provide the lightweight and strong musical instrument case.

Further advantages of the present invention will be apparent in view of the detailed description below.

BRIEF DESCRIPTION OF THE DRAWINGS

The invention will now be described in more detail with reference to the appended drawings, wherein.

DETAILED DESCRIPTION OF THE INVENTION

Figure 1:
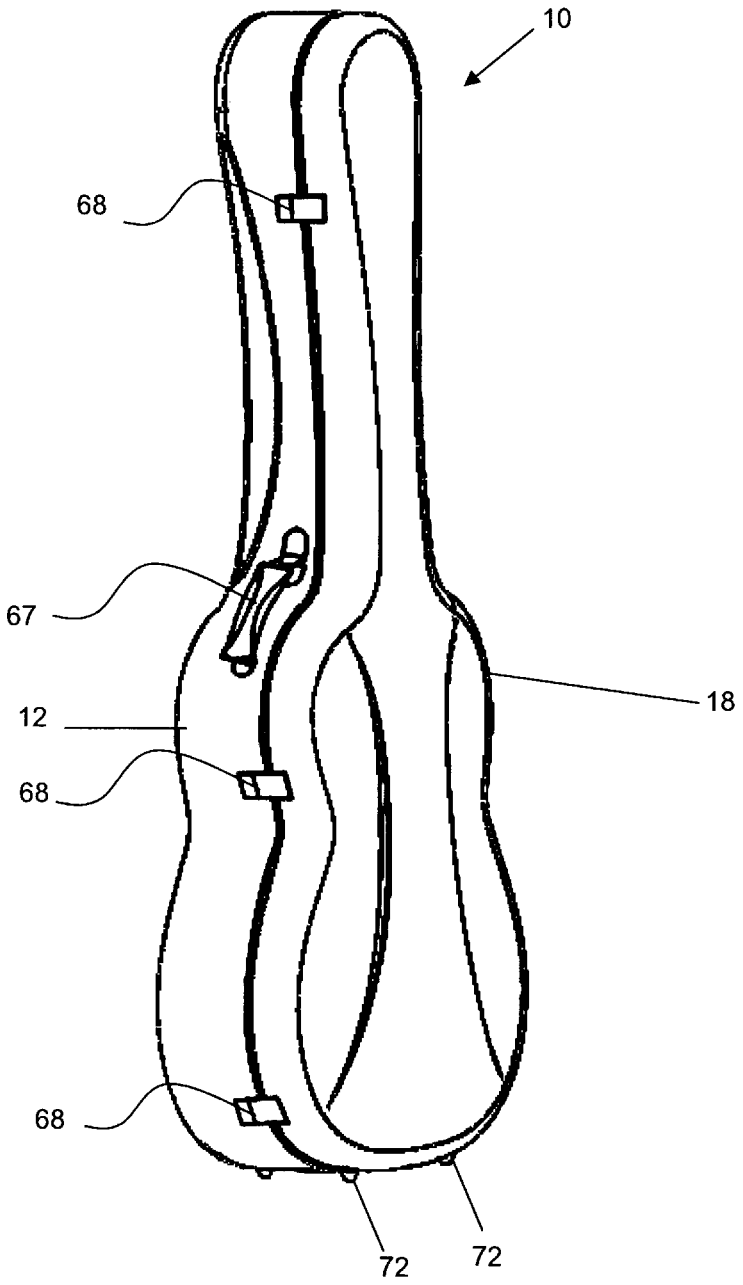
FIG. 1 shows a perspective view of a musical instrument case illustrating an upper part of a cover according to a preferred embodiment of the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting but merely as a basis for claims. It should be understood that the drawings and detailed description thereto are not intended to limit the invention to the particular form disclosed, but on the contrary, the invention is to cover all modification, equivalents and alternatives falling within the scope of the present invention as defined by the appended claims. As used throughout this application, the word "may" is used in a permissive sense (i.e., meaning having the potential to), rather than the mandatory sense (i.e., meaning must). Similarly, the words "include," "including," and "includes" mean including, but not limited to. Further, the words "a" or "an" mean "at least one" and the word "plurality" means one or more, unless otherwise mentioned. Where the abbreviations of technical terms are used, these indicate the commonly accepted meanings as known in the technical field. For ease of reference, common reference numerals will be used throughout the figures when referring to the same or similar features common to the figures. The present invention will now be described with reference to FIGS. 1-17.

The present invention relates to a musical instrument case (10) for storing a musical instrument, especially stringed musical instruments such as guitar as well as other types of instrument having similar shape to the guitar, in which the instrument comprising a head, a neck and a body section.

Figure 2:
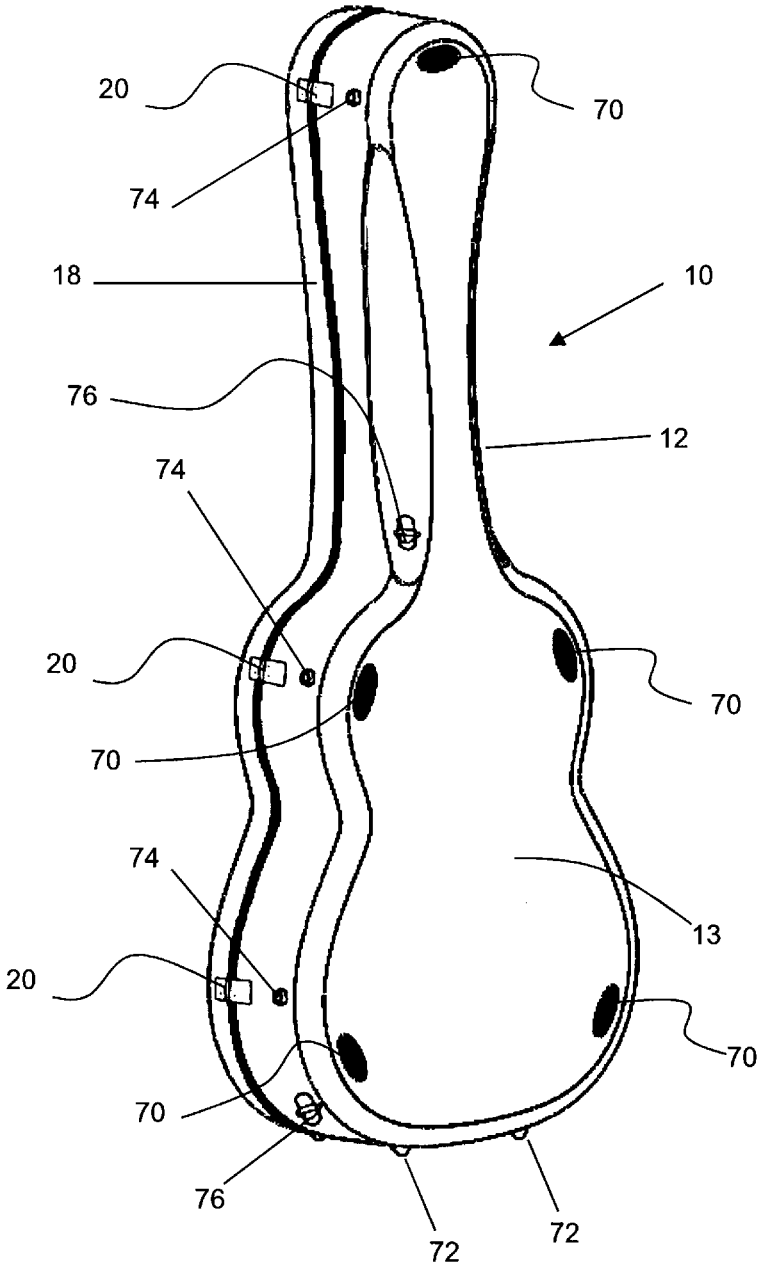
FIG. 2 shows a perspective view of the musical instrument case illustrating a lower part of a case body.
Figure 3:
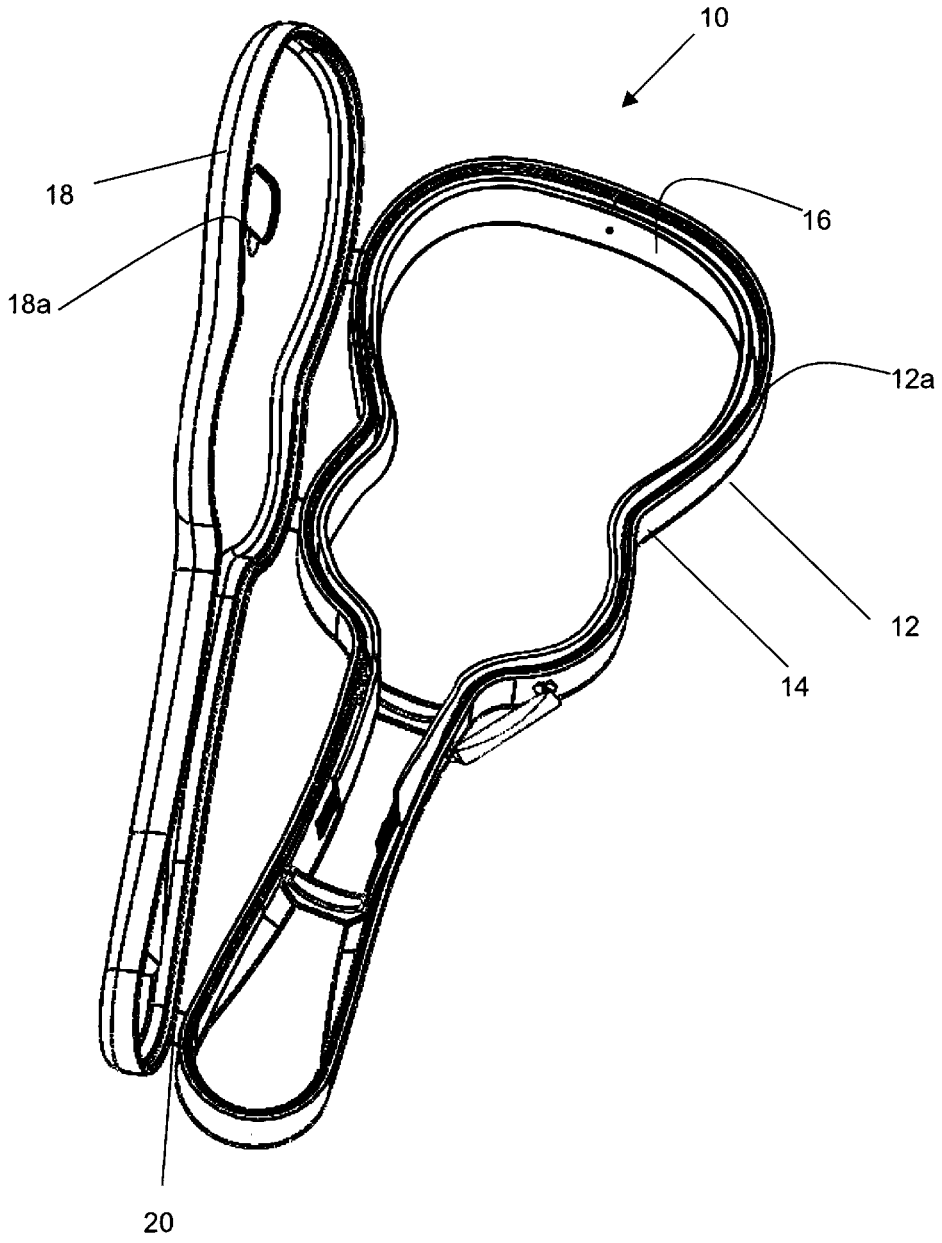
FIG. 3 shows a perspective view of the musical instrument case illustrating the case body attached to the cover by hinges.

As shown in FIGS. 1, 2 and 3, the musical instrument case (10) comprises a case body (12) and a cover (18). The case body (12) comprises an outer wall (14) and an inner wall (16) for storing the musical instrument therein. The case body (12) is attached to the cover (18) by hinges (20) so that the cover (18) is connected to the case body (12) as the cover (18) open.

Figure 4:
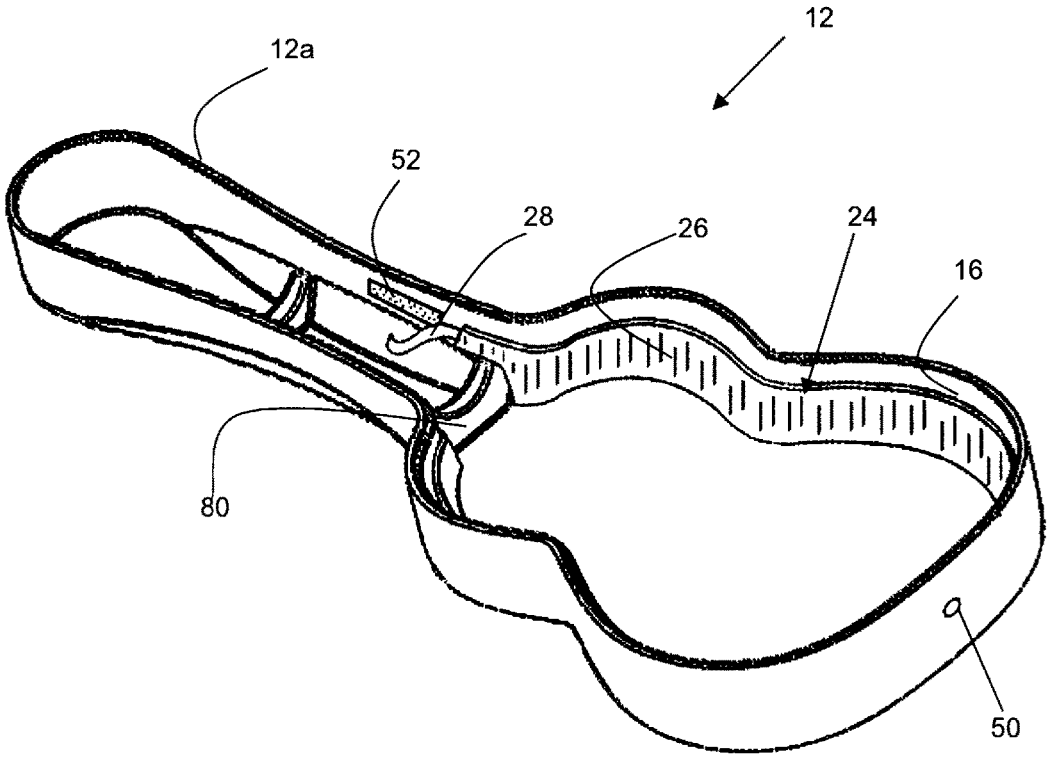
FIG. 4 shows the case body comprising an adjustable supporting means attached to an inner wall.
Figure 5:
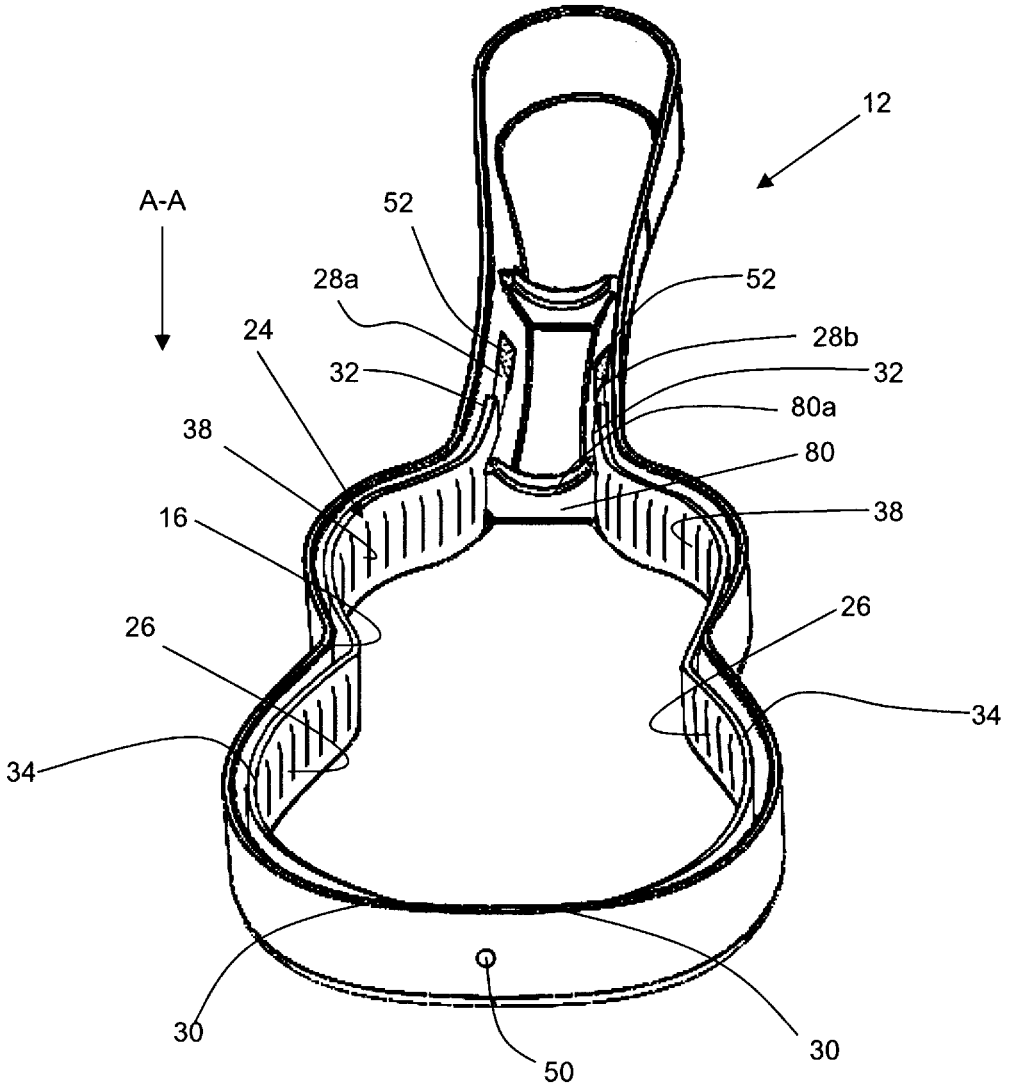
FIG. 5 shows the case body comprising the adjustable supporting means attached to the inner wall in normal state that a rope is not pulled.
Figure 6:
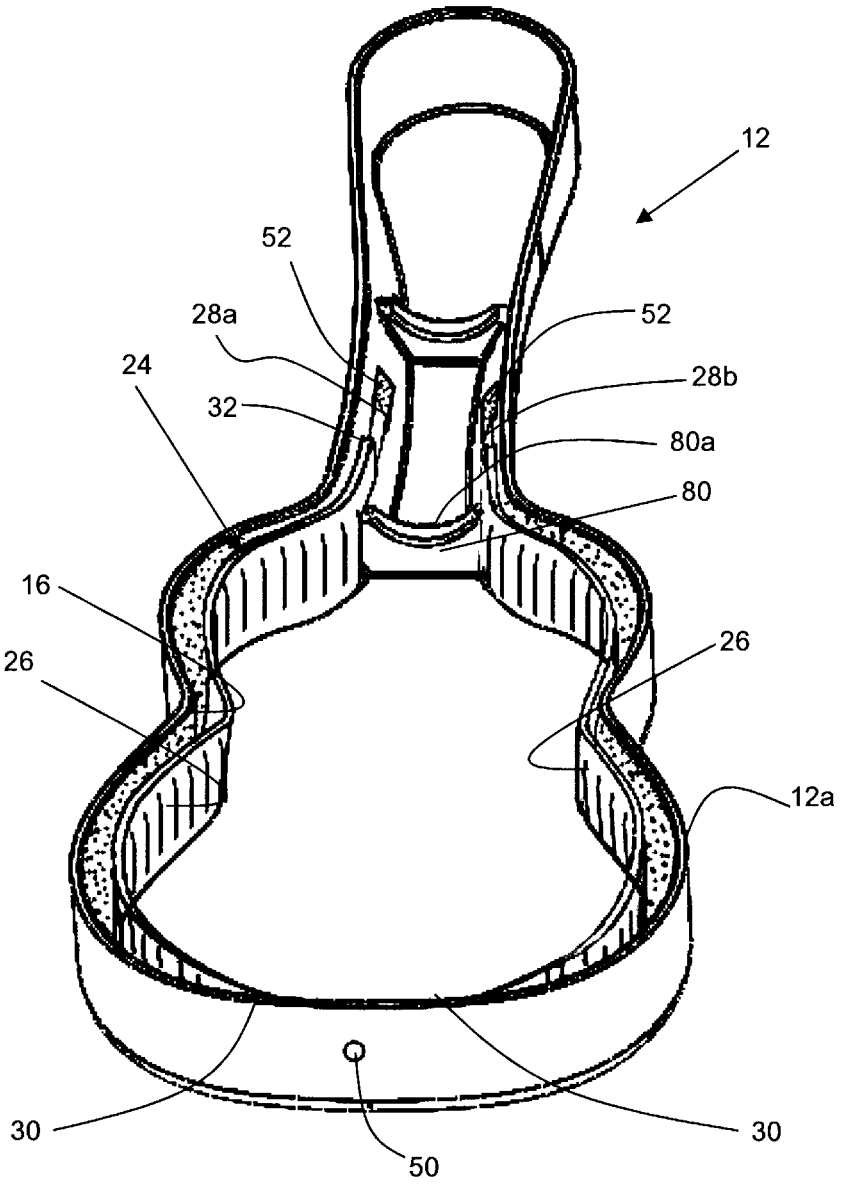
FIG. 6 shows the case body comprising the adjustable supporting means attached to the inner wall wherein the rope is pulled for adjusting the adjustable supporting means to securely grip a musical instrument.

As shown in FIGS. 4, 5 and 6, the case body (12) comprises an adjustable supporting means (24) attached to the inner wall (16) of the case body (12) at an area for storing the body section of the musical instrument. The adjustable supporting means (24) comprises at least one of a cushioning unit (26) connected each other by a rope (28). The rope (28) is provided inside the cushioning unit (26) wherein when the rope (28) is pulled, the cushioning unit (26) will be expanded to securely grip the musical instrument.

In a preferred embodiment, the adjustable supporting means (24) comprises two cushioning units (26) connected each other by the rope (28). Preferably, the rope (28) is a flat rope, ribbon, clothing ribbon or plastic rope.

Figure 7:
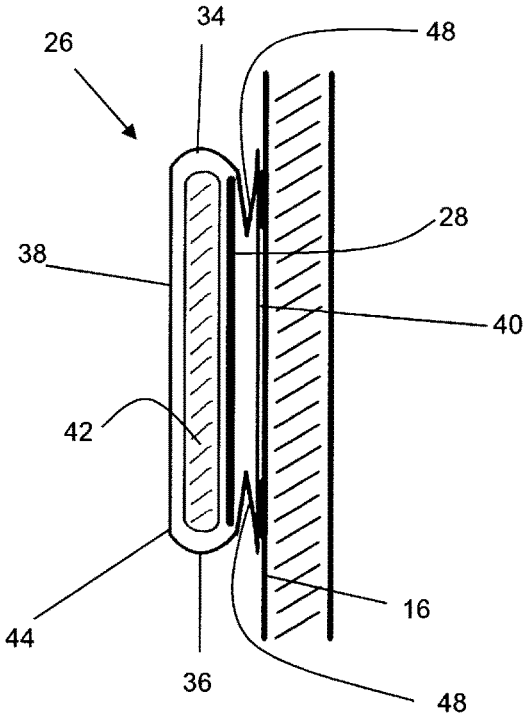
FIG. 7 shows a cross sectional view of a cushioning unit taken along line A-A of the FIG. 5 with the rope in normal state.
Figure 8:
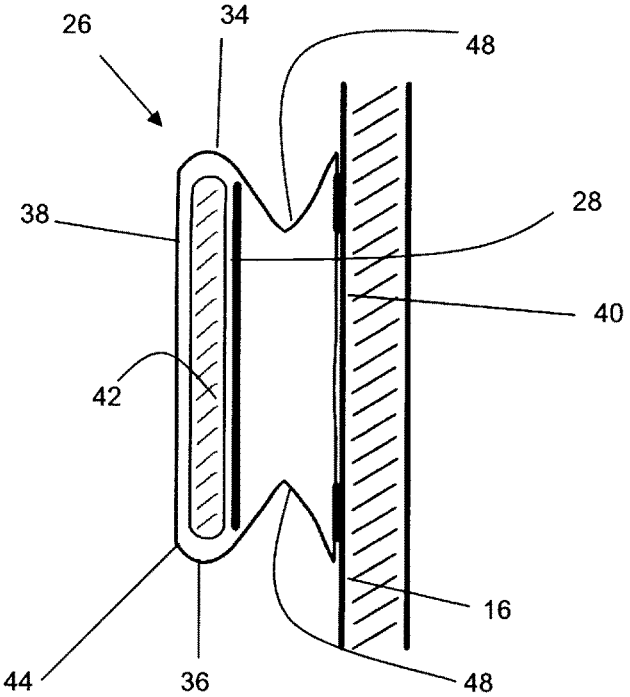
FIG. 8 shows a cross sectional view of the cushioning unit taken along line A-A of FIG. 5 wherein the rope is pulled and a crease is expanded pushing a soft material to securely grip the musical instrument.

FIGS. 7 and 8 show a cross section view of the cushioning unit (26) taken along the line A-A of FIG. 5. The cushioning unit (26) comprises an upper closing end (30), a lower opening end (32), an upper wall (34), a lower wall (36), a first side wall (38), and a second side wall (40). A soft material (42) is provided inside the cushioning unit (26). The cushioning unit (26) is enclosed with a fabric (44).

Figure 9:
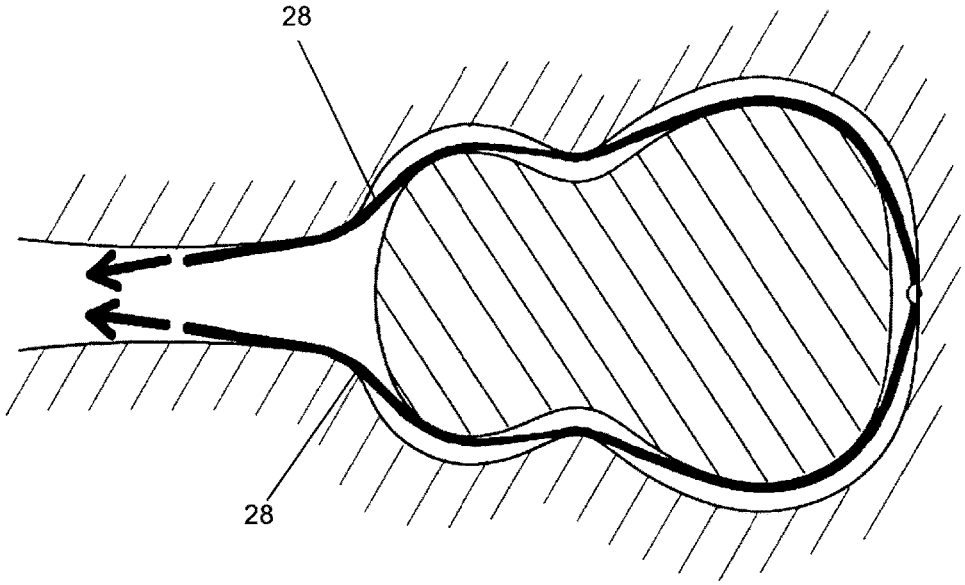
FIG. 9 shows a configuration of a movement of the rope of the musical instrument case when receiving the pulling force.

FIG. 7 shows the cushioning unit (26) in a normal state, wherein the cushioning unit (26) has not yet been expanded to securely grip the musical instrument. The soft material (42) is provided inside the cushioning unit (26) and attached to the first side wall (38) by attachment means such as adhesive or sewing. The rope (28) is provided adjacent to the soft material (42) wherein one end (28*a*) of the rope (28) is protruding from the lower opening end (32) of the first cushioning unit (26) and another end (28*b*) is protruding from the upper closing end (30) to a second cushioning unit (26) and protruding from the lower opening end (32) of the second cushioning unit (26). The rope (28) is attached to the fabric (44) by sewing at the area of the upper closing end (30) of each cushioning unit (26) as shown in FIGS. 5, 6 and 9.

The second side wall (40) is attached to the inner wall (16) of the case body (12) by a hook-and-loop fastener such as VELCRO tape or adhesive. The upper wall (34) and the lower wall (36) of the cushioning unit (26) include a crease (48) wherein when the rope (28) is pulled, the crease (48) is expanded pushing the soft material (42) to securely grip the musical instrument. The second side wall (40) is attached to the inner wall (16) of the case body (12) by VELCRO tape or adhesive, as shown in FIG. 8.

The rope (28) is connected to each cushioning unit (26). The rope (28) is fixed with the inner wall (16) of the musical instrument case (10) at the area that supporting a lower body of the musical instrument, by a fastening means (50) such as rivet or nail, as shown in FIGS. 4, 5, and 6.

As shown in FIGS. 5 and 6, the ends (28*a*, 28*b*) of the rope (28) that protruding from the lower opening end (32) of each cushioning unit (26) is attached to the inner wall (16) by VELCRO tape (52). The user can pull the rope (28) to adjust the adjustable supporting means (24) for securely gripping the musical instrument. Then, the user can attach the ends (28*a*, 28*b*) to the inner wall (16) by VELCRO tape (52).

As shown in FIGS. 4, 5, and 6, the second side wall (40) of the cushioning unit (26) is attached to the inner wall (16) of the case body (12) by VELCRO tape or adhesive. The adjustable supporting means (24) is attached along the inner wall (16) of the case body (12) at the area for receiving the body section of the musical instrument such as guitar or other musical instruments having a shape similar to the guitar.

In the preferred embodiment of the cushioning unit (26), the term "upper" and "lower", as used herein for describing the cushioning unit (26), are referring to the appended drawings and with reference to the alignment of the musical instrument case (10) in which the body case (12) is in a lying position. The musical instrument case (10) for receiving the neck portion of the instrument is near the user in order to pull the ends (28*a*, 28*b*) of the rope (28). The portion that is near to the ends (28*a*, 28*b*) is defined as the lower part of the cushioning unit (26) and the portion that is far from the ends (28*a*, 28*b*) is defined as upper part of the cushioning unit (26). The terms are used for ease of description of the specific structural and functional features but not to be interpreted as limiting the scope of the invention.

The upper closing end (30) is the end that is adjacent to the lower part of the body of the musical instrument.

The lower opening end (32) is the end that is adjacent to the neck of the musical instrument and the end (28*a*, 28*b*) of the rope (28).

The upper wall (34) is close to the cover (18) when the musical instrument case (10) is closed.

The lower wall (36) is near to a base of the case body (12).

Figure 10:
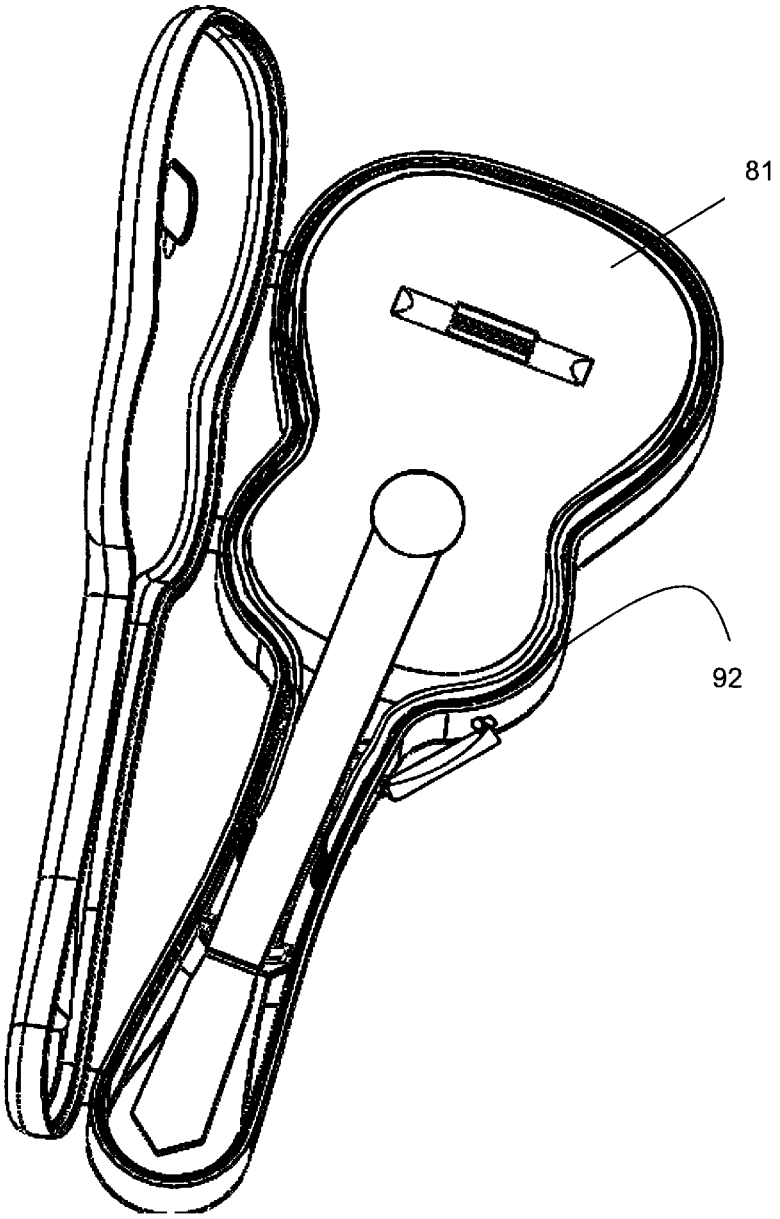
FIG. 10 shows the musical instrument case storing a guitar wherein the adjustable supporting means is in normal state in which the rope is not pulled.
Figure 11:
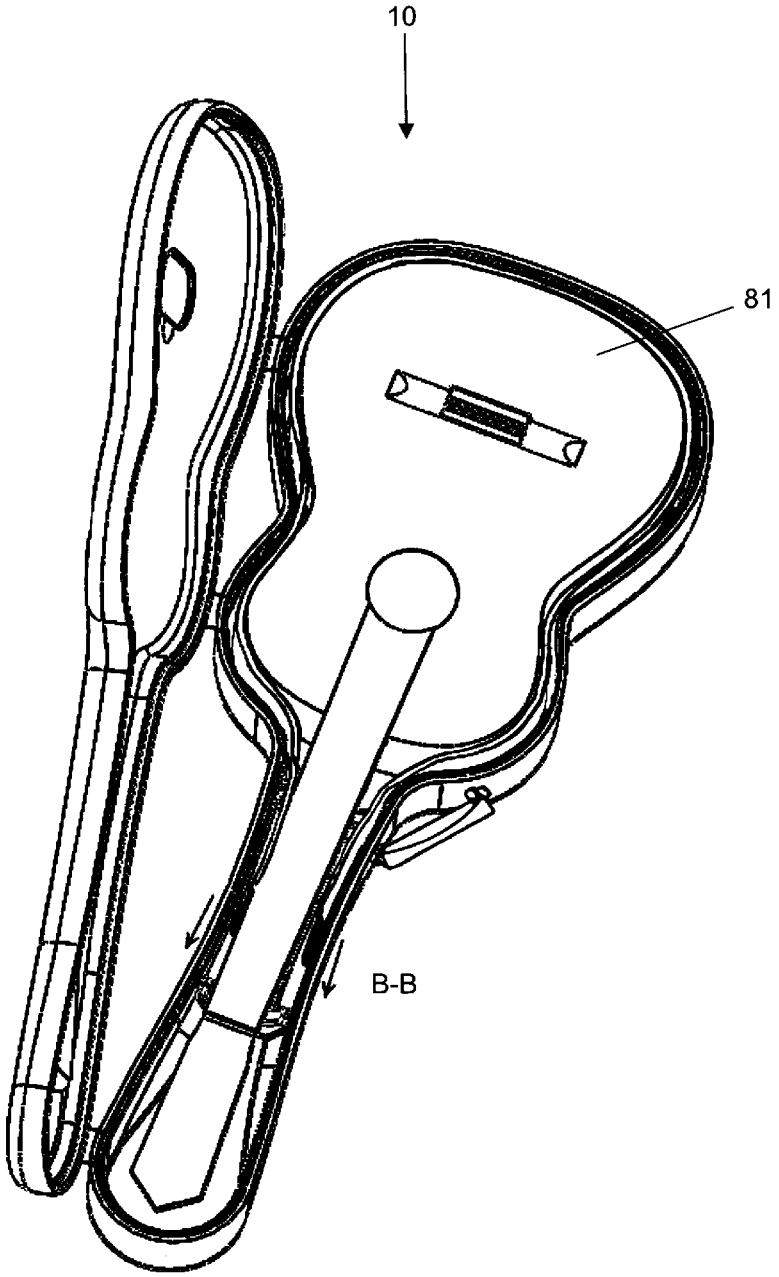
FIG. 11 shows the musical instrument case storing the guitar wherein the rope is pulled.

As shown in FIGS. 10 and 11, in use, when the musical instrument such as a guitar (81) is contained in the case body (12), there will be a space (92) between the musical instrument and the cushioning units (26). The user will then pull the ends (28*a*, 28*b*) of the rope (28) along the line B-B. After the rope (28) is pulled, the rope (28) will adjust to a linear line along the pulling force. As shown in FIG. 9, the case body (12) at the area for storing the body of the musical instrument includes curves according to the shape of the musical instrument. In addition, the second side wall (40) is attached to the inner wall (16), therefore, when the rope (28) is pulled, the crease (48) will be expanded in accordance with the force that the rope (28) becomes more linear, but the second side wall (40) is fixed, the cushioning unit (26) will securely grip the musical instrument according to the shape of the musical instrument. After the cushioning unit (26) is securely gripping the musical instrument that is the musical instrument is in the center of the case body (12), then the ends (28*a*, 28*b*) is attached to the inner wall (16) by VELCRO tape (52).

After the adjustable supporting means (24) is properly adjusted to securely grip the musical instrument, that position of the adjustable supporting means (24) is still remained unchanged even the musical instrument is removed from the case body. It can be called as 'shape memory'. Therefore, the user can store and remove the same musical instrument without adjusting the adjustable supporting means (24). This is because of the end (28*a*, 28*b*) of the rope (28) is attached to the inner wall (16) by VELCRO tape (52) and remain the adjustable supporting means (24) in the position that is adjusted and fixed.

With the shape of the musical instrument case (10) for storing instrument including the curves to correspond to the shape of the instrument, the rope (28) can act as shock absorbing support in case of the musical instrument case (10) receiving the bump attack.

In case of the user changes the musical instrument for storing in the musical instrument case (10), the user can adjust the adjustable supporting means (24) to fit with the new musical instrument by pulling or loosen the rope (28) in order for the crease (48) to be expanded or shrunk to properly fit to the musical instrument.

Therefore, in accordance with the preferred embodiment, the cushioning unit (26) includes the soft material (42) for supporting the musical instrument wherein the cushioning unit (26) can be expanded to securely grip the musical instrument by pulling the rope (28). This would help the musical instrument securely gripped inside and decrease the reaction force incurred from the impact between the musical instrument and the musical instrument case (10).

In addition, another embodiment of the adjustable supporting means (24) is that each of the cushioning unit (26) includes each rope (28) therein. In use, the end of each rope (28) is fixed to the inner wall of the case body (12) by fastening means (50) such as rivets or nails at the area for supporting the body of the instrument.

The preferred soft material (42) is sponge or soft foam pad.

Figure 12:
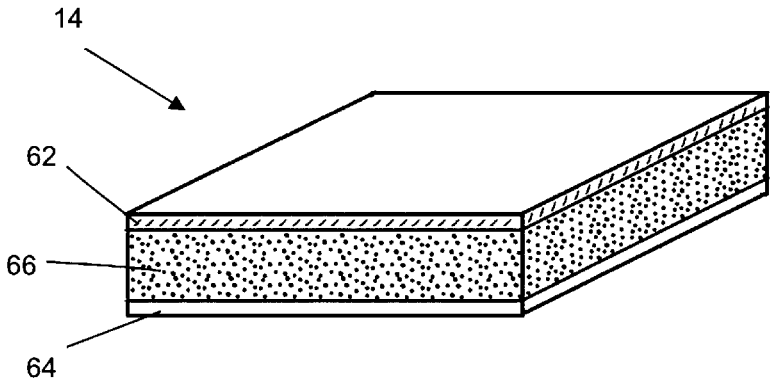
FIG. 12 shows a cross sectional view of a first exemplary embodiment of the outer wall of the musical instrument case.
Figure 13:
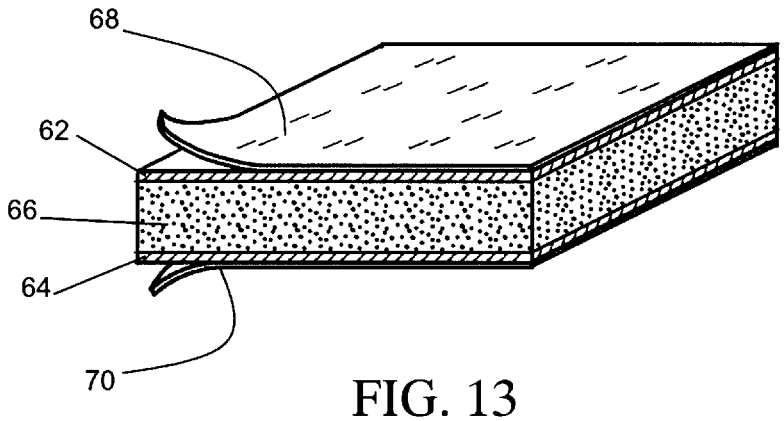
FIG. 13 shows a cross sectional view of a second exemplary embodiment of the outer wall of the musical instrument case.

The outer wall (14) of the musical instrument case (10) comprises multiple layers of material including an upper layer (62), a lower layer (64) and a middle layer (66) is between the upper layer (62) and the lower layer (64), as shown in FIGS. 12 and 13.

The upper layer (62) and the lower layer (64) is made from thermoplastic including Polyvinyl Chloride (PVC), Acrylonitrile-butadiene-styrene (ABS), High Impact Polystyrene (HIPS), and Polyethylene Terephthalate (PET). In addition, the upper layer (62) and the lower layer (64) can be made from composite thermoplastic plastic including Epoxy, Polyester, Carbon fiber, and other type of fiber.

The middle layer (66) is made from Polyurethane foam.

In manufacturing of the musical instrument case (10), the upper layer (62) and the lower layer (64) is formed by thermoforming process, casting process, or molding process. The upper layer (62) is provided on a female mold and the lower layer (64) is provided on the male mold and forming into the musical instrument case (10) by polyurethane reaction injection molding process. The reaction injection molding process is the process involves injecting low viscous polymer into a heated mold to form the musical instrument case (10).

Polyurethane foam resin which is in liquid state comprising two types of liquid polymer including Polyol and Isocyanate that were mixed together and injected into the mold with high pressure. Two mentioned polymers will react and swell or swells up and is activated by heat and harden to Polyurethane foam and coordinating the upper layer (62) and the lower layer (64) into one piece to be the case body (12) and the cover (18) according to a predetermined mold.

According to the preferred embodiment, the upper layer (62) and the lower layer (64) is made from Acrylonitrile-butadiene-styrene (ABS).

As shown in FIG. 13, another embodiment of the outer wall (14) of the musical instrument case (10) comprises the upper layer (62), the lower layer (64) and the middle layer (66), and the upper layer (62) is coated with Polyvinyl chloride (PVC). The lower layer (64) is also lined with a reinforced fabric (70). The lower layer (64) is the layer that is in contact with the musical instrument.

The musical instrument case (10) is for storing the musical instrument, in particular guitar (81) or other instrument having similar shape to the guitar, such as ukulele, violin, etc.

As shown in FIGS. 1 and 2, the musical instrument case (10) further comprises a handle (67) and at least one latch (68) attached on the outer wall (14) for securely locked the case body (12) with the cover (18). In addition, the case body (12) further comprises stands (70, 72, 74) at an outer base (13) of the musical instrument case (10) for protection of the musical instrument case (10) from bumps or scratching when the musical instrument case (10) is in a lying position. The musical instrument case (10) further comprises at least two loops (76) for configuring with a supporting strap.

Figure 14:
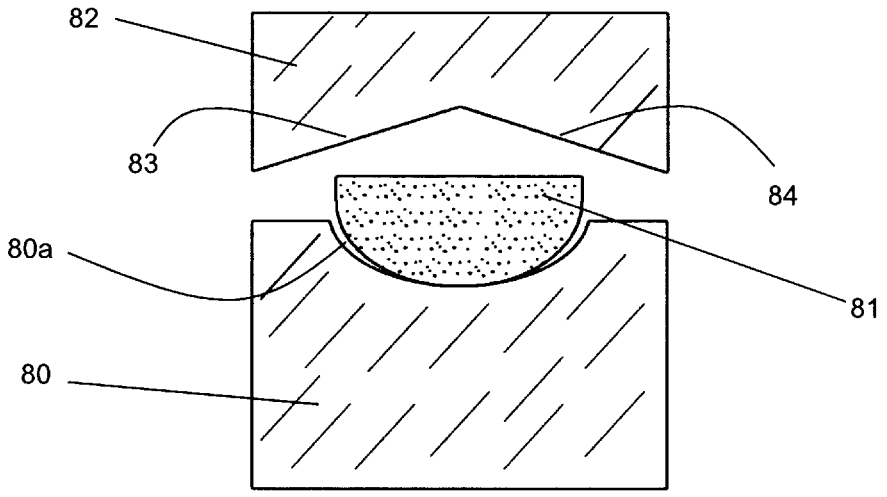
FIG. 14 shows supporting sponges providing inside the case body and the cover at the area for supporting a neck of the musical instrument when the musical instrument case is opened.
Figure 15:
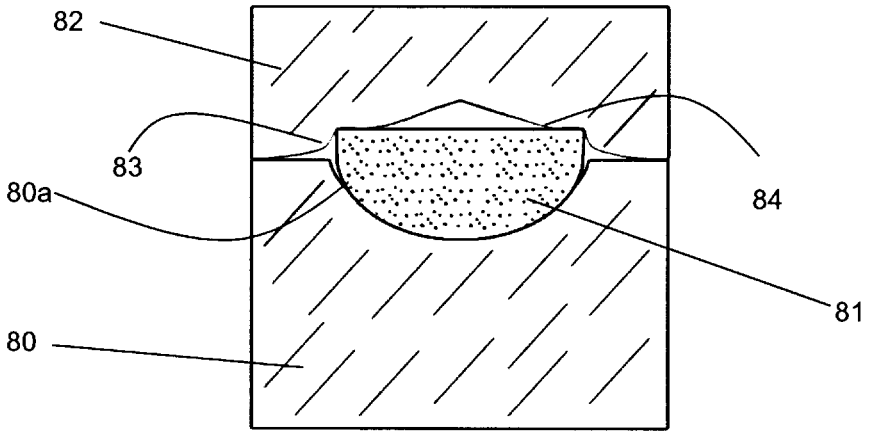
FIG. 15 shows the supporting sponges inside the case body and the cover at the area for supporting a neck of the musical instrument when the musical instrument case is closed.
Figure 16:
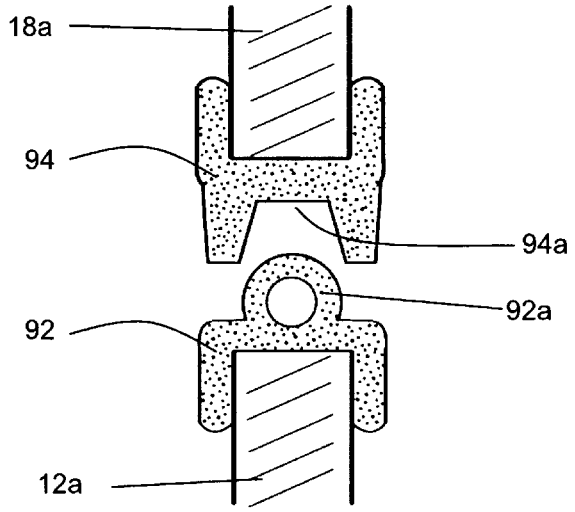
FIG. 16 shows a rubber rim of an edge of the case body, wherein the musical instrument case is partially closed.
Figure 17:
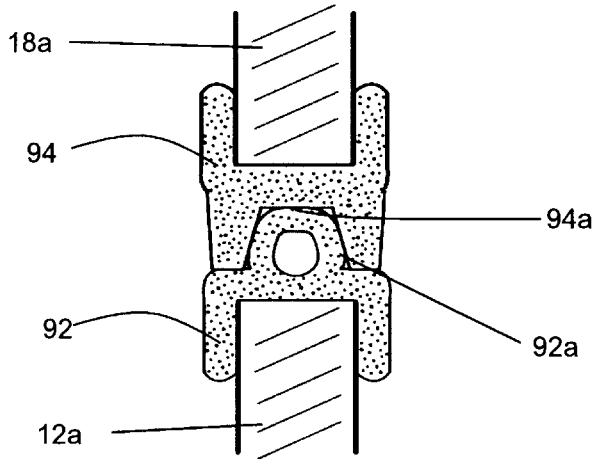
FIG. 17 shows the rubber rim of the edge of the case body, wherein the musical instrument case is fully closed.

As shown in FIGS. 14 and 15, the musical instrument case (10) further comprises a supporting sponge (80) inside the case body (12) and another supporting sponge (82) inside the cover (18) at the area supporting a neck of the musical instrument, in which the supporting sponge (80) including concave surface (80*a*) that is corresponding with the neck of the musical instrument wherein the neck of the musical instrument is gripped between the supporting sponges (80, 82) when the musical instrument case (10) is closed.

As shown in FIG. 15, the supporting sponge (82) has a triangular shape surface with two sides (83, 84) wherein the supporting sponge (82) is for securely gripping the neck of a guitar (81) when the musical instrument case (10) is closed. According to the flexibility and softness of the supporting sponges (80, 82), the supporting sponges (82) will get deformed acquiring an angled-shaped structure to encircle the neck of the instrument. It would help prevent the guitar (81) from lateral movement within the musical instrument case (10).

The advantage of the supporting sponges (80, 82) is that the neck of the guitar (81) will securely grip within the musical instrument case (10). It would help prevent the guitar (81) from lateral movement within the musical instrument case (10) when receiving bump impact. In addition, in use of the musical instrument case (10) comprising the adjustable supporting means (24) as well as the supporting sponges (80, 82), it would help securely grip the guitar (81) and prevent the guitar (81) from any movement when the musical instrument case (10) is moved or transported. It also decreases the chance that the neck of the guitar (81) is broken when receiving the bump impact.

As shown in FIG. 10, the case body (12) further comprises an edge (12*a*) wherein the edge (12*a*) is coupled with a rubber rim (92) having a loop end (92*a*) and the cover (18) further comprising an edge (18*a*) wherein the edge (18*a*) is coupled with a rubber rim (94) having socket (94*a*) for receiving the loop end (92*a*) of the rubber rim (92). According to this configuration, it would help the case body (12) securely close with the cover (18) and preventing liquid from leaking into the musical instrument case (10).

The invention claimed is:

1. A musical instrument case (10) for storing a musical instrument, comprising:

a case body (12) having an inner wall (16);

a cover (18) is attached to the case body (12);

an adjustable supporting means (24) is affixed on the inner wall (16) wherein the adjustable supporting means (24) comprising at least one of cushioning unit (26), and each cushioning unit (26) is connected by a rope (28);

wherein the cushioning unit (26) is expanded to securely grip the musical instrument when the rope (28) is pulled.

2. The musical instrument case (10) according to claim 1, wherein the cushioning unit (26) comprising an upper closing end (30), a lower opening end (32), an upper wall (34), a lower wall (36), a first side wall (38) and a second side wall (40) wherein a soft material (42) is enclosed inside the cushioning unit (26) and the second side wall (40) is attached to the inner wall (16) of the case body (12).

3. The musical instrument case (10) according to claim 2, wherein the upper wall (34) and the lower wall (36) comprising a crease (48) wherein when the rope (28) is pulled, the crease (48) is expanded pushing the soft material (42) to securely grip the musical instrument.

4. The musical instrument case (10) according to claim 2, wherein the soft material (42) is attached to the first side wall (38) and the rope (28) is provided adjacent to the soft material (42) wherein one end (28*a*) of the rope (28) is protruding from the lower opening end (32) of the first cushioning unit (26) and another end (28*b*) is connected with a second cushioning unit (26) and another end (28*b*) is protruding from the upper closing end (30) to a second cushioning unit (26) and protruding from the lower opening end (32) of the second cushioning unit (26).

5. The musical instrument case (10) according to claim 1, wherein the adjustable supporting means (24) is attached to the inner wall (16) in the area that supporting a body of the musical instrument.

6. The musical instrument case (10) according to claim 1, wherein the rope (28) is flat rope or ribbon or fabric string or plastic string.

7. The musical instrument case (10) according to claim 1, wherein the end (28*a*, 28*b*) of the rope (28) is attached to the inner wall by hook-and-loop fastener such as VELCRO tape.

8. The musical instrument case (10) according to claim 1, wherein the rope (28) is connected between each cushioning unit (26) in which the rope (28) is fixed by a fastening means (50) with the inner wall (16) of the musical instrument case (10) at the area that supporting a lower body of the music instrument.

9. The musical instrument case (10) according to claim 1, wherein each rope (28) is provided inside each of the cushioning unit (26) wherein the end of the rope (28) protruding from the upper closing end (30) of each cushioning unit (26) and is fixed by the fastening means (50) with the inner wall (16) of the musical instrument case (10) at the area that supporting the lower body of the musical instrument.

10. The musical instrument case (10) according to claim 2, wherein the second side wall (40) of the cushioning unit (26) is attached to the inner wall (16) of the case body (12) by hook-and-loop fastener such as VELCRO tape or adhesive.

11. The musical instrument case (10) according to claim 1, having an outer wall (14) comprising multiple layers of material including an upper layer (62), a lower layer (64) wherein a middle layer (66) is in between the upper layer (62) and the lower layer (64).

12. The musical instrument case (10) according to claim 11, wherein the upper layer (62) and the lower layer (64) is made from thermoplastic selected from Polyvinyl Chloride (PVC), Acrylonitrile-butadiene-styrene (ABS), High Impact Polystyrene (HIPS), Polyethylene Terephthalate (PET).

13. The musical instrument case (10) according to claim 11, wherein the upper layer (62) and the lower layer (64) is made from composite thermoplastic plastic that is selected from Epoxy, Polyester, Carbon fiber.

14. The musical instrument case (10) according to claim 11, wherein the upper layer (62) and the lower layer (64) is formed by thermoforming process, casting process, or molding process and forming into the musical instrument case (10) by reaction injection molding process.

15. The musical instrument case (10) according to claim 1, wherein the case body (12) further comprising an edge (12*a*) wherein the edge (12*a*) is coupled with a rubber rim (92) having a loop end (92*a*) and the cover (18) further comprising an edge (18*a*) wherein the edge (18*a*) is coupled with a rubber rim (94) having socket (94*a*) for receiving the loop end (92*a*) of the rubber rim (92).

* * * * *